US011387601B2

(12) United States Patent
Miyazawa

(10) Patent No.: US 11,387,601 B2
(45) Date of Patent: Jul. 12, 2022

(54) CONNECTOR

(71) Applicant: SUMITOMO WIRING SYSTEMS, LTD., Mie (JP)

(72) Inventor: Kiyohito Miyazawa, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/074,799

(22) Filed: Oct. 20, 2020

(65) Prior Publication Data

US 2021/0135400 A1 May 6, 2021

(30) Foreign Application Priority Data

Nov. 1, 2019 (JP) ..... JP2019-199668

(51) Int. Cl.
*H01R 13/629* (2006.01)
*H01R 13/502* (2006.01)

(52) U.S. Cl.
CPC ..... *H01R 13/62938* (2013.01); *H01R 13/502* (2013.01)

(58) Field of Classification Search
CPC ..... H01R 13/62938; H01R 13/502; H01R 13/506; H01R 13/5812; H01R 24/20; H01R 13/516; H01R 13/64
USPC ..... 439/352
See application file for complete search history.

(56) References Cited

U.S. PATENT DOCUMENTS 8,221,142 B2 * 7/2012 Sakamaki ..... H01R 13/62955 439/157
8,882,521 B2 * 11/2014 Conway ..... H01R 13/62977 439/157
9,774,127 B2 * 9/2017 Yamaki ..... H01R 13/506
2002/0173197 A1 * 11/2002 Endo ..... H01R 13/641 439/489
2013/0330959 A1 * 12/2013 Bashkin ..... H01R 13/62955 439/372
2014/0206213 A1 * 7/2014 Kato ..... H01R 13/62 439/157
2017/0117660 A1 * 4/2017 Furuya ..... H01R 13/4538
2018/0083385 A1 * 3/2018 Akagi ..... H01R 13/62938
2018/0109033 A1 * 4/2018 Tashiro ..... H01R 13/501
(Continued)

FOREIGN PATENT DOCUMENTS

JP 2006-073326 A 3/2006
JP 2015-220019 A 12/2015
JP 2018-200745 A 12/2018

*Primary Examiner* — Abdullah A Riyami
*Assistant Examiner* — Nelson R. Burgos-Guntin
(74) *Attorney, Agent, or Firm* — Venjuris, P.C.

(57) ABSTRACT

A first mounting portion 31 of a housing 10 includes first lock portions 33. A second lock portion 32 of the housing 10 includes a second lock portion 37 and an interfering portion 38 arranged side by side with the second lock portion 37. A first mount receiving portion 66 of a cover 60 includes first lock receiving portions 68 to be locked by the first lock portions 33. A second mount receiving portion 67 of the cover 60 includes a second lock receiving portion 69 to be locked by the second lock portion 37 and an escaping space 71, the interfering portion 38 being arranged in the escaping space 71. The first lock portion 33 and the interfering portion 38 are arranged at positions inverted 180° with a center of a rear surface portion 28 in a back view of the housing 10 as a center.

6 Claims, 11 Drawing Sheets

(56) References Cited

U.S. PATENT DOCUMENTS

| | | | | |
|---|---|---|---|---|
| 2018/0109036 | A1* | 4/2018 | Akagi | H01R 13/641 |
| 2019/0372269 | A1* | 12/2019 | Hirota | H01R 13/631 |
| 2020/0153162 | A1* | 5/2020 | Mamiya | H01R 13/4223 |
| 2021/0066847 | A1* | 3/2021 | Tanimura | H01R 13/5219 |
| 2021/0066850 | A1* | 3/2021 | Tanimura | H01R 13/4538 |

* cited by examiner

CONNECTOR

CROSS-REFERENCE TO RELATED APPLICATIONS

This application is based on and claims priority from Japanese Patent Application No. 2019-199668, filed on Nov. 1, 2019, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. 2018-200745 includes a housing and a wire cover (hereinafter, referred to as a cover) to be mounted to cover a rear surface side of the housing. The cover protects wires pulled out from the rear surface side of the housing. The cover includes resilient lock pieces provided with lock projections. The housing includes recess-like locked portions. If the cover is held on the housing, the lock projections of the resilient lock pieces are locked to the locked portions. A connector provided with a cover of this type is also disclosed in Japanese Patent Laid-open Publication Nos. 2006-073326 and 2015-220019.

SUMMARY

The aforementioned locked portions are arranged in a point-symmetric manner in a back view on four corner parts around the rear surface side of the housing (see FIG. 12 of Japanese Patent Laid-open Publication No. 2018-200745). In this case, the cover can be mounted in two mounting postures, in which wire draw-out directions are opposite. Then, an operator may mount the wire cover on the housing in the mounting posture inverted from the original posture.

Accordingly, the present disclosure aims to provide a connector in which a cover can be mounted in a proper posture on a housing.

The present disclosure is directed to a connector with a housing including a rear surface portion facing rearward, and a cover for surrounding a wire pulled out from the rear surface portion side, wherein the housing includes a first mounting portion and a second mounting portion provided around the rear surface portion, the cover includes a first mount receiving portion and a second mount receiving portion to be respectively mounted to the first and second mounting portions, the first mounting portion includes a first lock portion, the second mounting portion includes a second lock portion and an interfering portion arranged side by side with the second lock portion, the first mount receiving portion includes a first lock receiving portion to be locked by the first lock portion and the second lock receiving portion includes a second lock receiving portion to be locked by the second lock portion and an escaping space, the interfering portion being arranged in the escaping space, and the first lock portion and the interfering portion are arranged at positions inverted 180° with a center of the rear surface portion in a back view of the housing as a center.

According to the present disclosure, it is possible to provide a connector in which a cover can be mounted in a proper posture on a housing.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
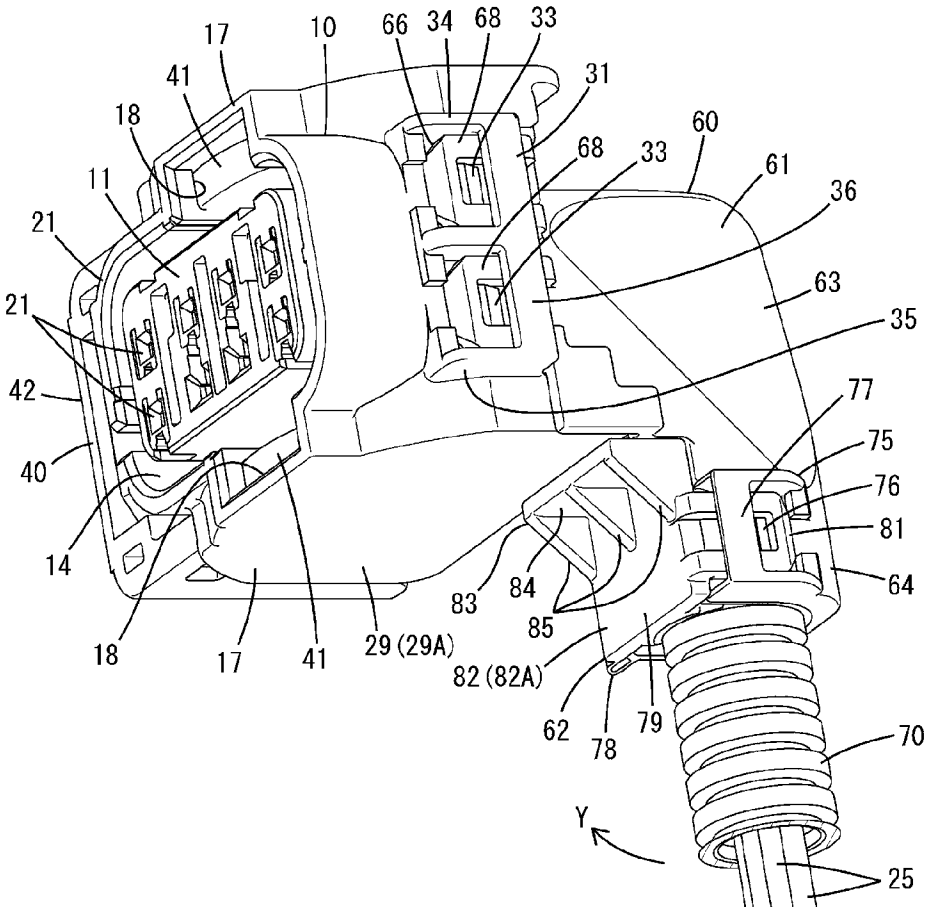
FIG. 1 is a perspective view of a connector viewed obliquely from a lower-front side in one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure is provided with a housing including a rear surface portion facing rearward, and a cover for surrounding a wire pulled out from the rear surface portion side, wherein the housing includes a first mounting portion and a second mounting portion provided around the rear surface portion, the cover includes a first mount receiving portion and a second mount receiving portion to be respectively mounted to the first and second mounting portions, the first mounting portion includes a first lock portion, the second mounting portion includes a second lock portion and an interfering portion arranged side by side with the second lock portion, the first mount receiving portion includes a first lock receiving portion to be locked by the first lock portion and the second lock receiving portion includes a second lock receiving portion to be locked by the second lock portion and an escaping space, the interfering portion being arranged in the escaping space, and the first lock portion and the interfering portion are arranged at positions inverted 180° with a center of the rear surface portion in a back view of the housing as a center. According to this configuration, the second lock portion is locked to the second lock receiving portion and the interfering portion is arranged in the escaping space, whereby the cover is properly held on the housing. On the other hand, if the cover is in a mount posture different from a proper mount posture, the interfering portion interferes with the first lock portion.

Thus, a situation where the cover in the mount posture different from the proper one is held on the housing can be avoided.

(2) A plurality of the first lock portions may be provided side by side in a back view in the first mounting portion, the second lock portion(s) less than the first lock portions may be provided in the second mounting portion, and one of the plurality of first lock portions may be arranged at the position inverted 180° with respect to the interfering portion. According to this configuration, since an operator can easily recognize each lock portion by confirming a difference between the number of the first lock portions and that of the second lock portion(s), a cover mounting operation can be quickly started.

(3) The housing may include a fitting tube portion, a mating connector being fit inside the fitting tube portion, and the interfering portion may be formed by causing a part of the fitting tube portion to bulge outward and an erroneous assembly preventing protrusion of the mating connector may be arranged inside the interfering portion. According to this configuration, if an attempt is made to assemble the mating connector in an erroneous assembly posture different from a proper assembly posture with the housing, a part of the mating connector other than the erroneous assembly preventing protrusion can interfere with the interfering portion. Thus, a situation where the mating connector in the erroneous posture is erroneously connected to the housing can be avoided. Here, since the interfering portion has a function of preventing erroneous connection of the mating connector and a function of preventing erroneous mounting of the cover, the configuration of the housing can be simplified as compared to the case where the both functions are separately provided.

(4) The connector may include a lever rotatably arranged on the housing to proceed with connection to the mating connector, the lever may be arranged outside the cover, and the cover may include a laterally projecting portion projecting in a direction intersecting a rotating direction of the lever. If the cover is held in a mount posture different from a proper mount posture on the housing, the lever interferes with the laterally projecting portion during rotation and a lever rotating operation cannot proceed. In that respect, according to this configuration, the first mounting portion and the first mount receiving portion are mountable to each other and the second mounting portion and the second mount receiving portion are mountable to each other, whereby a state where the cover is properly held on the housing is ensured. Therefore, a situation where the lever interferes with the laterally projecting portion during rotation can be reliably avoided.

Details of Embodiment of Present Disclosure

Hereinafter, a specific example of the connector of the present disclosure is described with reference to the drawings. Note that the present invention is not limited to these illustrations and is intended to be represented by claims and include all changes in the scope of claims and in the meaning and scope of equivalents.

Embodiment

Figure 2:
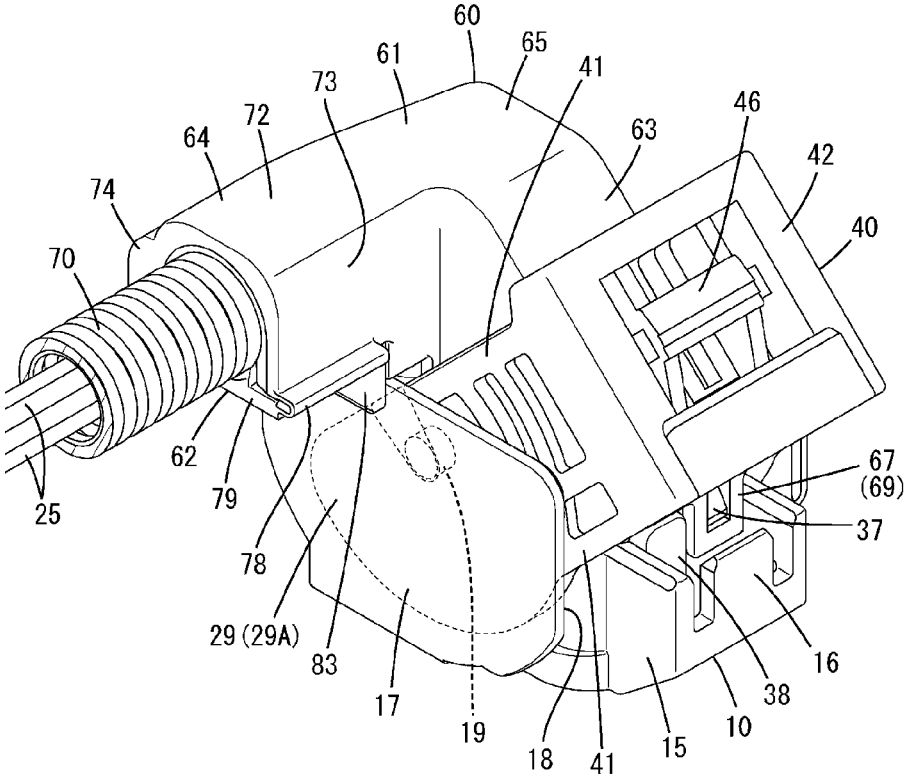
FIG. 2 is a perspective view of the connector viewed obliquely from an upper-rear side with a lever arranged at an initial position.

A connector of one embodiment includes, as shown in FIGS. 1 and 2, a housing 10, a lever 40 to be rotatably supported on the housing 10 and a cover 60 to be mounted on the housing 10. The housing 10 is connectable to a mating connector 90. Note that, in the following description, a surface side of the housing 10 facing the mating connector 90 at the start of connection is referred to as a front side concerning a front-rear direction. A vertical direction is based on a vertical direction of FIGS. 5, 6, 8 and 9. A lateral direction is synonymous with a width direction and based on a lateral direction of FIGS. 3, 4 and 7 to 11.

<Mating Connector 90>

Figure 5:
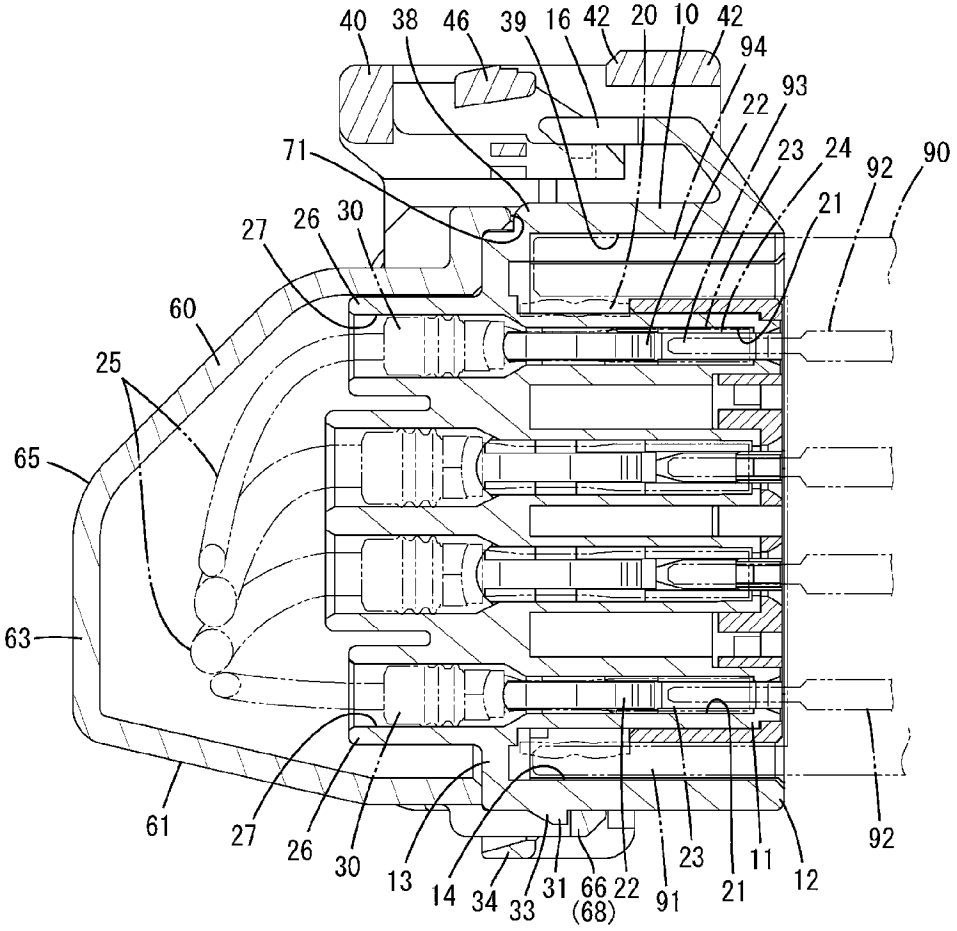
FIG. 5 is a section along A-A of FIG. 4.

Although not shown in detail, the mating connector 90 includes a receptacle 91 and a plurality of mating terminal fittings 92 as shown in FIG. 5. The mating terminal fitting 92 is made of conductive metal and includes a tab 93 projecting into the receptacle 91. The receptacle 91 is made of synthetic resin and in the form of a rectangular tube long in the vertical direction. An erroneous assembly preventing protrusion 94 is provided on one widthwise side of an upper wall of the receptacle 91. The erroneous assembly preventing protrusion 94 is in the form of a rib extending in the front-rear direction on the upper surface of the upper wall of the receptacle 91. Unillustrated cam followers are provided to project on left and right surfaces of the receptacle 91.

<Housing 10>

Figure 8:
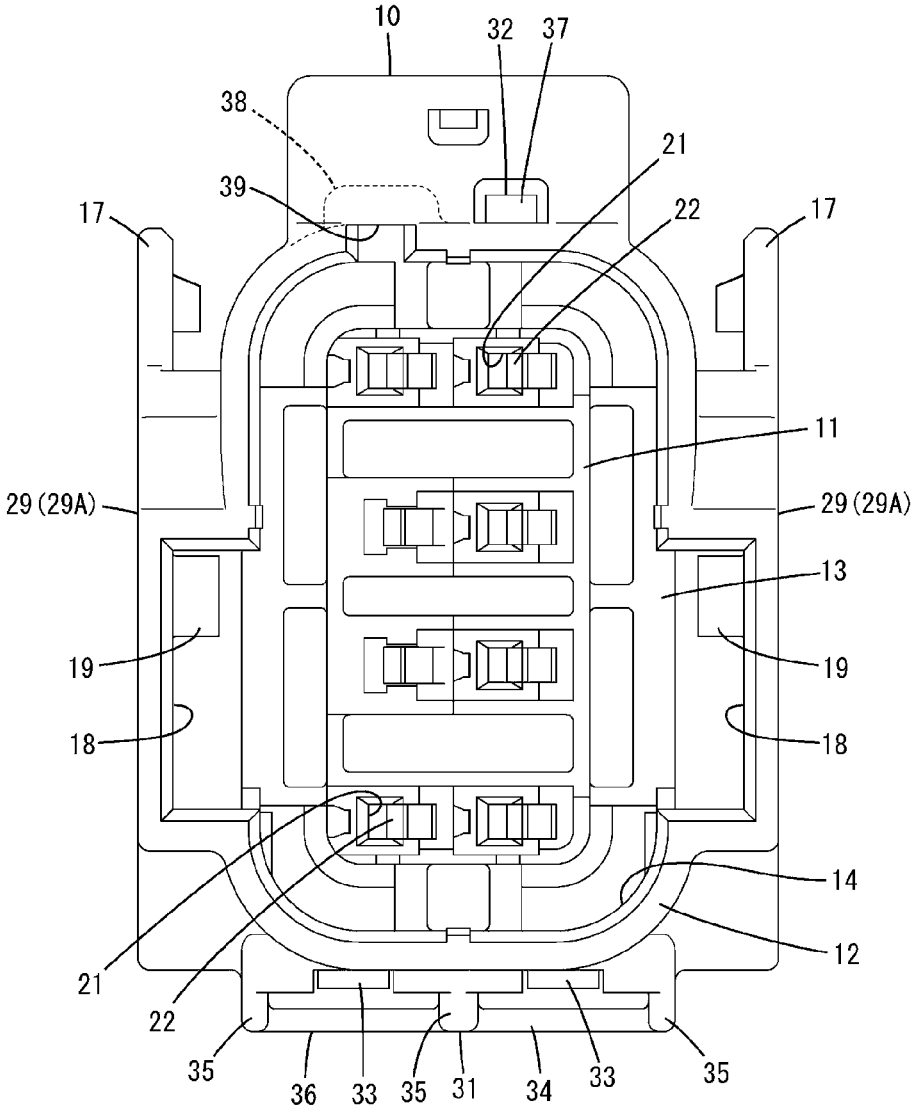
FIG. 8 is a front view of a housing.

The housing 10 is made of synthetic resin and includes, as shown in FIG. 8, a housing body 11 in the form of a rectangular block, a fitting tube portion 12 surrounding the housing body 11, and a rear wall 13 coupling the fitting tube portion 12 and the housing body 11 in a rear part. A seal ring 20 is mounted on a rear end part of the outer periphery of the housing body 11 as shown in FIG. 5.

A space between the fitting tube portion 12 and the housing body 11 and forward of the rear wall 13 is configured as a fitting space 14. The receptacle 91 of the mating connector 90 is inserted into the fitting space 14 from front. Here, sealing is provided between the receptacle 91 and the housing body 11 via the seal ring 20 in a liquid-tight manner.

Figure 9:
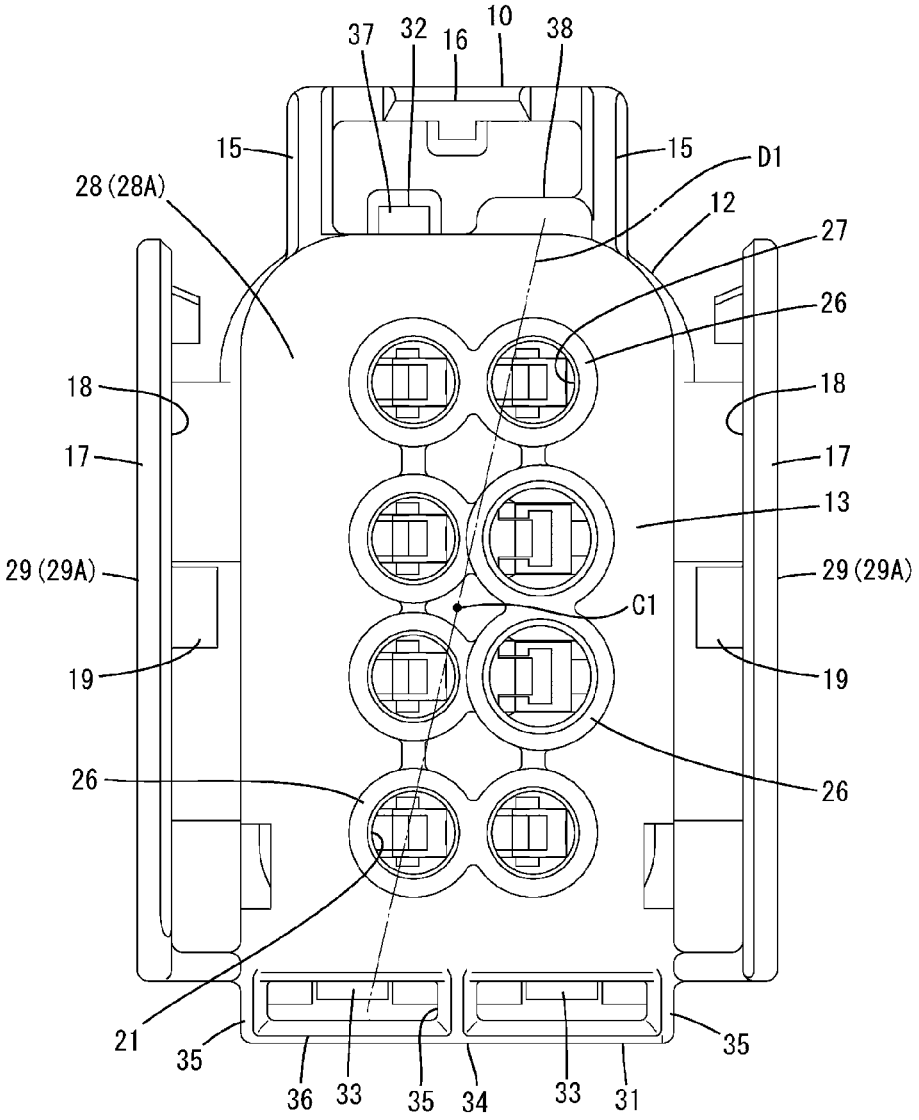
FIG. 9 is a back view of the housing.

As shown in FIG. 9, the fitting tube portion 12 has a rectangular shape in a back view. Upper and lower surfaces of the fitting tube portion 12 are laterally arranged. Left and right surfaces of the fitting tube portion 12 are vertically arranged. Widths of the upper and lower surfaces of the fitting tube portions 12 are smaller than heights of the left and right surfaces of the fitting tube portion 12. That is, the upper and lower surfaces of the fitting tube portion 12 constitute short-side regions and the left and right surfaces of the fitting tube portion 12 constitute long-side regions.

Figure 6:
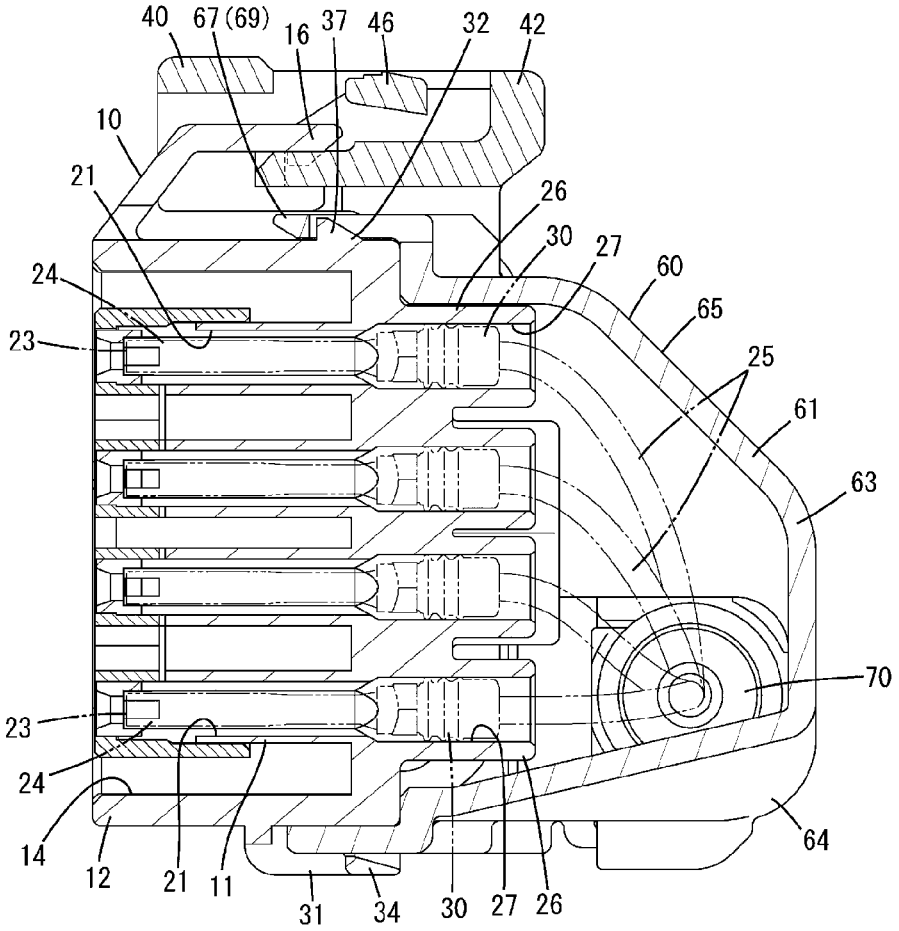
FIG. 6 is a section along B-B of FIG. 4.

A pair of left and right leg portions 15 are provided to stand on the upper surface of the fitting tube portion 12. A deflectable lock arm 16 is provided between the upper ends of the both leg portions 15. As shown in FIGS. 5 and 6, the lock arm 16 restricts the rotation of the lever 40 at a connection position (to be described later) by locking the lever 40.

As shown in FIG. 9, the housing 10 includes a pair of left and right outer walls 17 lateral to the left and right surfaces of the fitting tube portion 12. A pair of left and right space portions 18 are provided between the left and right surfaces of the fitting tube portion 12 and the facing outer walls 17. The both space portions 18 are elongated in the vertical direction, closed on upper parts of front ends and lower ends (see FIG. 8) and open on rear ends (FIG. 9). Later-described arm portions 41 of the lever 40 are inserted into the both space portions 18. The both outer walls 17 are in the form of plates along the vertical direction and arranged to cover the arm portions 41. The both outer walls 17 are provided with cylindrical support shafts 19 projecting into the space portions 18.

As shown in FIG. 8, the housing body 11 includes a plurality of cavities 21. As shown in FIGS. 5 and 6, a terminal fitting 23 is inserted into each cavity 21 from behind. The terminal fitting 23 is locked by a locking lance 22 projecting from an inner wall of the cavity 21 and retained in the housing 10. The terminal fitting 23 is made of conductive metal and includes a tubular connecting portion 24 into which the tab 93 is inserted for connection. A wire 25 is connected to a rear part of the terminal fitting 23 by crimping.

As shown in FIG. 9, the housing 10 includes a plurality of seal towers 26 projecting rearward from the rear wall 13. Each seal tower 26 has a hollow cylindrical shape and has a seal hole 27 having a circular cross-section inside. As shown in FIGS. 5 and 6, the seal hole 27 of each seal tower 26 communicates with each cavity 21. A rubber plug 30 mounted on the outer periphery of the wire 25 is inserted into the seal hole 27 of each seal tower 26. The rubber plug 30 is held in close contact with the inner peripheral surface of the seal hole 27 to seal the inside of the housing 10 in a liquid-tight manner.

As shown in FIG. 9, the housing 10 includes a rear surface portion 28 facing rearward. The rear surface portion 28 has a rear surface 28A of the rear wall 13. The rear surface 28A of the rear wall 13 is arranged along the vertical direction and the lateral direction. The rear surface 28A of the rear wall 13 is arranged to be retracted forward from the rear end of each seal tower 26 and the rear ends of the both outer walls 17. Both left and right ends of the rear surface 28A of the rear wall 13 are facing the corresponding space portions 18 and arranged adjacent to the arm portions 41 of the lever 40.

The housing 10 includes housing side surface portions 29 facing laterally in a direction intersecting the front-rear direction. The housing side surface portions 29 have outer surfaces 29A of the both outer walls 17. As shown in FIGS. 1 and 2, the outer surface 29A of the outer wall 17 is a flat surface along the vertical direction and the front-rear direction.

As shown in FIG. 9, the housing 10 includes a first mounting portion 31 and a second mounting portion 32 around the rear surface portion 28 (in a peripheral part). The first and second mounting portions 31, 32 are structured to hold the cover 60 mounted on the housing 10 as described later. Specifically, the first and second mounting portions 31, 32 are provided on the upper and lower surfaces of the fitting tube portion 12 serving as the short-side regions. The first and second mounting portions 31, 32 are formed (shaped, arranged) not to be point-symmetric with respect to a center (center in each of the vertical direction and the lateral direction) of the housing 10 in a back view.

As shown in FIGS. 1, 3, 8 and 9, the first mounting portion 31 includes a pair of first lock portions 33 arranged at an interval in the lateral direction on the lower surface of the fitting tube portion 12. The both first lock portions 33 are in the form of projecting claws and have the same shape. As shown in FIG. 5, the rear surface of the first lock portion 33 is inclined downwardly. The front surface of the first lock portion 33 is arranged along the vertical direction.

Figure 3:
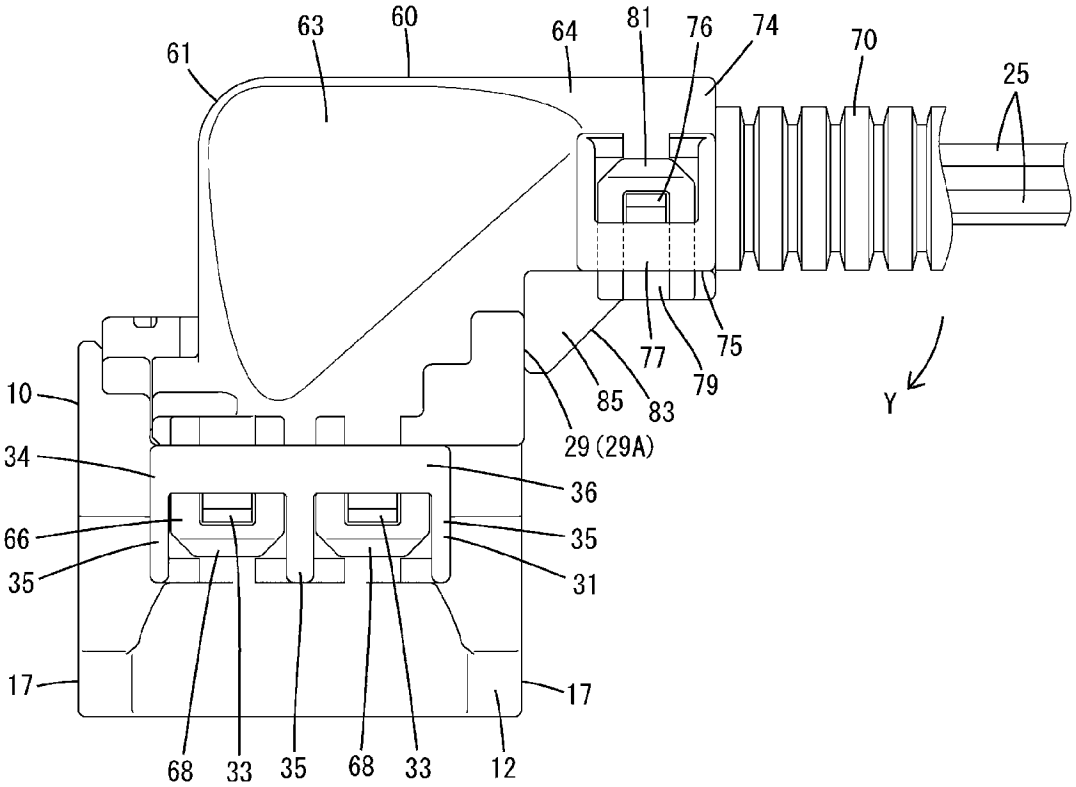
FIG. 3 is a bottom view of the connector.

Further, as shown in FIG. 1, the first mounting portion 31 includes a lock guide portion 34 in the form of a gate-shaped frame surrounding the both first lock portions 33. As shown in FIGS. 3, 8 and 9, the lock guide portion 34 includes support legs 35 standing between the both first lock portions 33 and on both left and right sides of the both first lock portions 33 on the lower surface of the fitting tube portion 12, and a bridge wall 36 extending in the lateral direction between rear lower ends of the respective support legs 35. The respective support legs 35 are arranged to entirely cover the both first lock portions 33 from both left and right sides. The bridge wall 36 is arranged at a position overlapping front end parts of the both first lock portions 33 with respect to the front-rear direction.

As shown in FIG. 9, the both leg portions 15 are arranged on both left and right sides of the second mounting portion 32. The lock arm 16 is arranged above the second mounting portion 32. The second mounting portion 32 includes a second lock portion 37 and an interfering portion 38 arranged at an interval in the lateral direction on the upper surface of the fitting tube portion 12. The second lock portion 37 is in the form of a projecting claw and has a width different from those of the first lock portions 33, particularly smaller than those of the first lock portions 33. Further, the second lock portion 37 has a height different from those of the first lock portions 33, particularly larger than those of the first lock portions 33. As shown in FIG. 6, the rear surface of the second lock portion 37 is inclined upwardly. The front surface of the second lock portion 37 is arranged along the vertical direction.

The interfering portion 38 is shaped by causing one widthwise side (left side of FIG. 8 and right side of FIG. 9) on the upper wall of the fitting tube portion 12 to bulge upward. Specifically, the interfering portion 38 has a gate-shaped cross-section and is shaped to extend in the front-rear direction on the one widthwise side of the upper wall of the fitting tube portion 12 (see FIG. 5). The interfering portion 38 projects on the upper surface of the upper wall of the fitting tube portion 12. The rear end (closing surface) of the interfering portion 38 is located behind the second lock portion 37. A width of the interfering portion 38 is larger than that of the second lock portion 37.

As shown in FIGS. 5 and 8, the interfering portion 38 includes an erroneous assembly preventing recess 39 in the form of a rectangular recess in the inner surface of the upper wall of the fitting tube portion 12. The erroneous assembly preventing recess 39 extends in the front-rear direction, is open in the front end of the fitting tube portion 12 and closed on the rear end of the fitting tube portion 12. As shown in FIG. 5, the erroneous assembly preventing protrusion 94 of the mating connector 90 is inserted into the erroneous assembly preventing recess 39 from front.

As shown in FIG. 9, the interfering portion 38 and the first lock portion 33 (first lock portion 33 on the left side of FIG. 9) are arranged at positions inverted 180° with a center C1 (center in width and height directions) of the rear surface portion 28 in a back view of the housing 10 as a center. That is, the interfering portion 38 and the first lock portion 33 are arranged on an inversion axis D1 passing through the center C1 of the rear surface portion 28.

<Lever 40>

Figure 10:
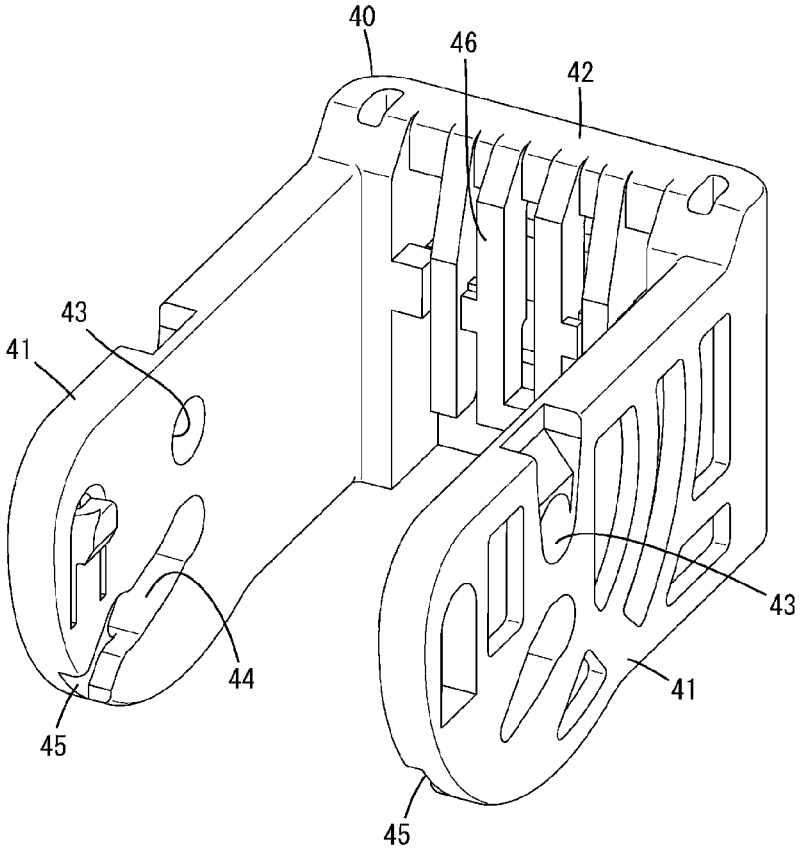
FIG. 10 is a perspective view of the lever viewed obliquely from a lower-front side.

The lever 40 is made of synthetic resin and includes, as shown in FIG. 10, a pair of left and right arm portions 41 and a coupling portion 42 extending between the both arm portions 41. The lever 40 is gate-shaped by being composed of the both arm portions 41 and the coupling portion 42. Each of the both arm portions 41 includes a circular bearing hole 43 and a cam groove 44 extending to the vicinity of the bearing hole 43. The both cam grooves 44 are shaped by recessing the inner surfaces of the both arm portions 41 and include entrances 45 open on the outer peripheral edges of the both arm portions 41. The lever 40 is rotatable from an initial position shown in FIG. 2 to the connection position shown in FIG. 1 about the bearing holes 43 (support shafts 19) with respect to the housing 10 with the both arm portions 41 arranged in the space portions 18 and the support shafts 19 fit in the bearing holes 43. At the initial position, the coupling portion 42 is arranged behind the housing 10 and the both arm portions 41 are partially arranged to project rearward through open parts on the rear ends of the space portions 18 as shown in FIG. 2. At the connection position, the coupling portion 42 is arranged on an upper end side of the housing 10 as shown in FIGS. 4 to 7. As shown in FIGS. 2 and 10, the coupling portion 42 includes a lever lock portion 46 inside a rectangular frame. As shown in FIGS. 5 and 6, the lever lock portion 46 is locked to the lock arm 16 at the connection position.

<Cover 60>

The cover 60 is made of synthetic resin, cap-shaped and mounted on the housing 10 from behind. As shown in FIGS. 5 and 6, the cover 60 surrounds the respective wires 25 pulled out from the respective seal towers 26.

Figure 4:
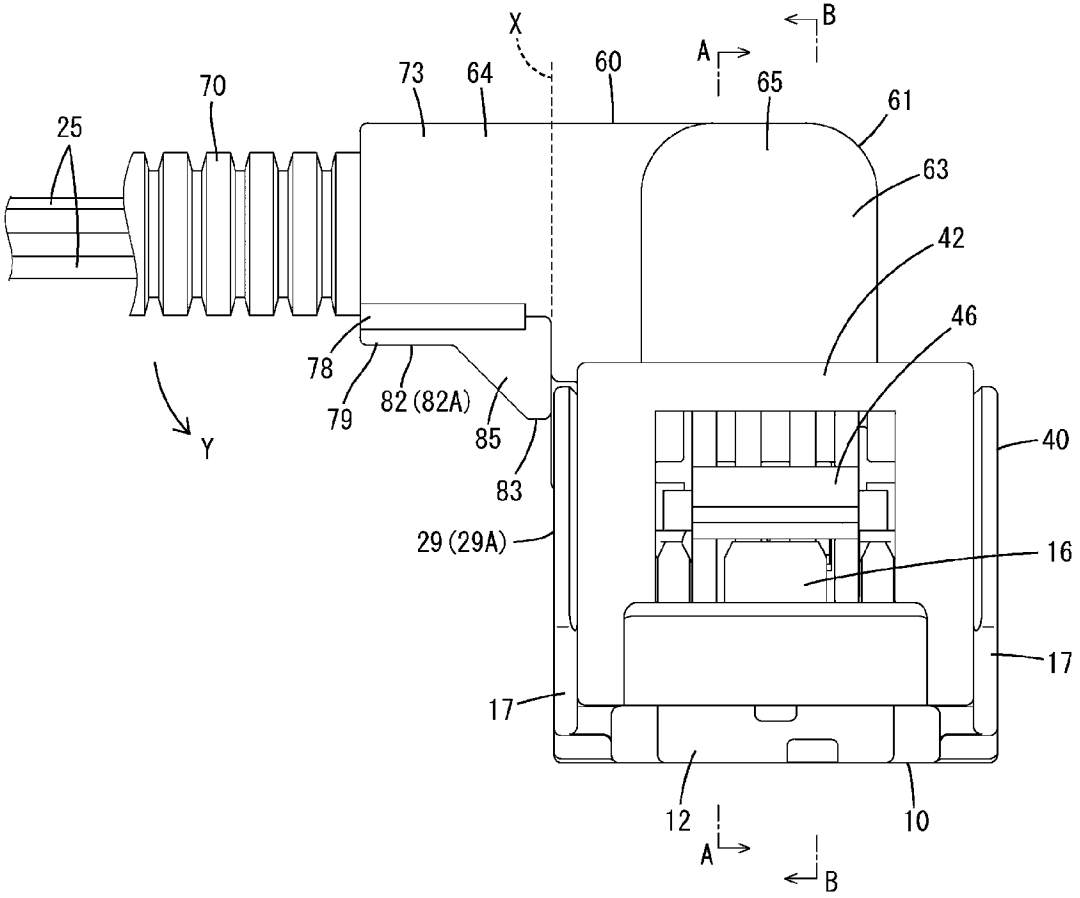
FIG. 4 is a plan view of the connector.
Figure 7:
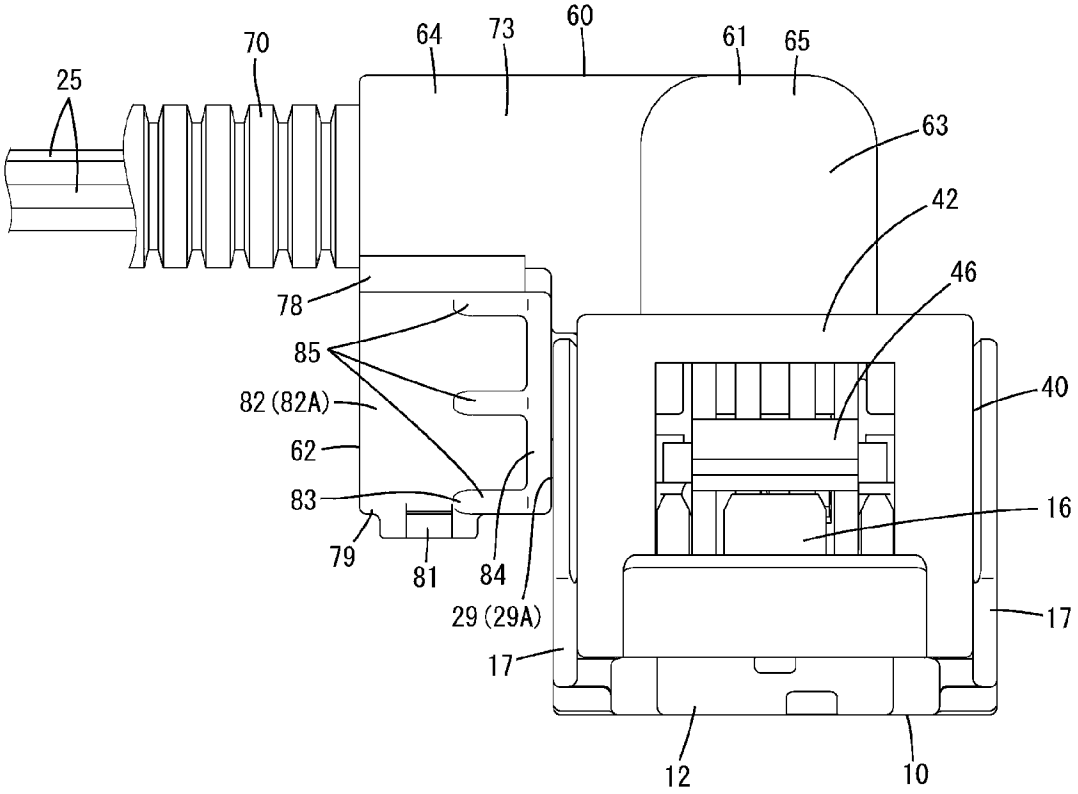
FIG. 7 is a plan view of the connector with a lid cover arranged in an open state with respect to a body cover.
Figure 11:
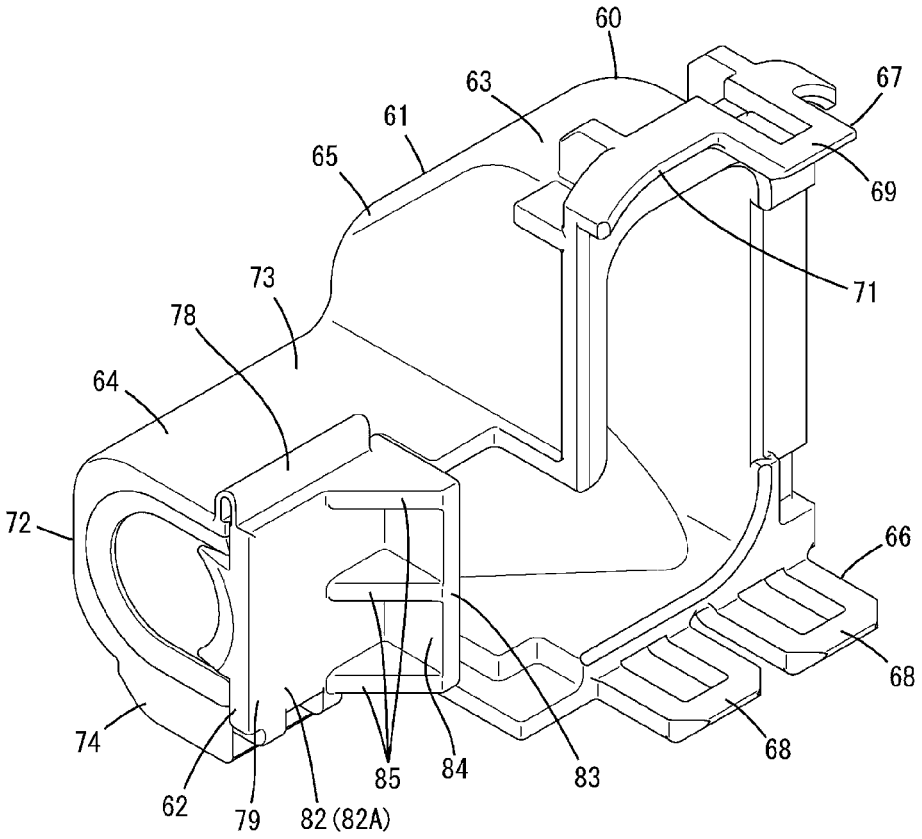
FIG. 11 is a perspective view of a cover viewed obliquely from an upper-front side.

As shown in FIG. 11, the cover 60 includes a body cover 61 and a lid cover 62 openably and closably coupled to the body cover 61 via a hinge 78. The body cover 61 includes a base portion 63 for covering the rear surface portion 28 from behind and a laterally projecting portion 64 bent from the base portion 63 and projecting toward one lateral side. As shown in FIGS. 3, 4 and 7, the body cover 61 is L-shaped in a back view by being composed of the base portion 63 and the laterally projecting portion 64.

The front end of the base portion 63 is an opening end and arranged to come into contact along the outer periphery of the rear surface 28A of the rear wall 13. The front end of the laterally projecting portion 64 is an opening edge communicating with the front end of the base portion 63 and closed by the lid cover 62.

The base portion 63 includes a back plate portion 65 arranged to face the rear surface portion 28. The base portion 63 has a slope region inclined toward the front end from a rear surface side of the laterally projecting portion 64. The lever 40 is located on the slope region of the base portion 63 and can avoid interference with the base portion 63 in a rotation process (see FIG. 2).

As shown in FIG. 11, the cover 60 includes a first mount receiving portion 66 and a second mount receiving portion 67 on upper and lower surfaces on a front end side of the base portion 63. The first and second mounting portions 31, 32 are respectively mounted into the first and second mount receiving portions 66, 67. The first and second mount receiving portions 66, 67 are formed (shaped, arranged) not to be point-symmetric with respect to a center (center in each of the vertical direction and the lateral direction) of the base portion 63 in a front view.

The first mount receiving portion 66 includes a pair of first lock receiving portions 68 arranged at an interval in the lateral direction on the lower surface of the base portion 63. The both first lock receiving portions 68 project forward from a lower side of the front end (opening end) of the base portion 63. Specifically, the both first lock portions 68 are in the from of rectangular frames along the front-rear direction and have the same shape. As shown in FIGS. 1 and 3, the corresponding first lock portions 33 are fit inside the both first lock receiving portions 68.

As shown in FIG. 11, the second mount receiving portion 67 includes a second lock receiving portion 69 on the upper surface of the base portion 63. The second lock receiving portion 69 projects forward from an upper side of the front end (opening end) of the base portion 63. Specifically, the second lock receiving portion 69 is in the form of a rectangular frame along the front-rear direction and has a width different from those of the first lock receiving portions 68, particularly smaller than those of the first lock receiving portions 68. As shown in FIG. 2, the second lock portion 37 is fit inside the second lock receiving portion 69.

As shown in FIG. 11, the second mount receiving portion 67 includes an escaping space 71 in a space on one widthwise side (left side of FIG. 11) adjacent to the second lock receiving portion 69 on the front end side of the base portion 63. As shown in FIG. 5, the interfering portion 38 is arranged in the escaping space 71.

As shown in FIG. 2, the laterally projecting portion 64 includes a laterally projecting back plate portion 72 connected at an angle to the back plate portion 65 and a first plate portion 73 and a second plate portion 74 projecting forward from both upper and lower sides of the laterally projecting back plate portion 72. The first plate portion 73 projects from an upper side of the laterally projecting back plate portion 72 and is located inside the cover 60 L-shaped in a back view. The second plate portion 74 projects from a lower side of the laterally projecting back plate portion 72 and is located outside the cover 60 L-shaped in the back view.

As shown in FIGS. 1 and 3, a cover lock receiving portion 75 is provided on the outer surface of the second plate portion 74. The cover lock receiving portion 75 includes a claw-like projection 76 and a bridge portion 77 provided around the projection 76. As shown in FIGS. 1, 2 and 11, the hinge 78 is a flexible hinge having a U-shaped cross-section and provided along the lateral direction on the front edge of the first plate portion 73. As shown in FIGS. 2, 4 and 7, an axis of the hinge 78 extends in a direction intersecting (particularly orthogonal to) the housing side surface portion 29 with the cover 60 held on the housing 10.

As shown in FIG. 11, the lid cover 62 includes a lid body 79 in the form of a rectangular plate. One end (upper end in a closed state) of the lid body 79 is coupled to the hinge 78. The other edge (lower edge in the closed state) of the lid body 79 is provided with a cover lock portion 81 projecting as shown in FIG. 1. The cover lock portion 81 is in the form of a rectangular frame and arranged along a direction orthogonal to the plate surface of the lid cover 62. As shown in FIGS. 1 and 3, the projection 76 of the cover lock receiving portion 75 is fit inside the cover lock portion 81.

When the lid cover 62 is in an open state with respect to the body cover 61, a corrugated tube 70 is inserted into the laterally projecting portion 64. With the corrugated tube 70 arranged in the laterally projecting portion 64, the lid cover 62 is rotated via the hinge 78. Thereafter, as shown in FIGS. 1 and 3, the cover lock portion 81 locks the cover lock receiving portion 75, whereby the lid cover 62 and the body cover 61 are held in the closed state with the corrugated tube 70 sandwiched therebetween. Note that the corrugated tube 70 is a flexible bellow tube which is made of synthetic resin and into which the wires 25 are inserted.

The cover 60 includes a cover side surface portion 82 arranged to face forward on a side (left side of a broken line X) near the outer surface 29A of the outer wall 17 constituting the housing side surface portion 29 with respect to a virtual plane (see the broken line X of FIG. 4) along the front-rear direction. The cover side surface portion 82 has an outer surface 82A of the lid body 79. In the case of this embodiment, as shown in FIG. 4, the outer surface 82A of the lid body 79 is arranged to be orthogonal to the outer surface 29A of the outer wall 17 and face forward.

As shown in FIGS. 1 and 11, the lid cover 62 includes a restricting portion 83 shaped to project on the outer surface 82A of the lid body 79. The restricting portion 83 includes a covering portion 84 projecting from one side edge near the base portion 63, out of both side edges intersecting one and the other edges of the body cover 79. The covering portion 84 is in the form of a rectangular plate and has plate surfaces along the vertical direction orthogonal to the outer surface 82A of the lid body 79. The covering portion 84 is provided over the entire length of the one side edge of the lid body 79 from the one edge side toward the other edge side of the lid body 79. The outer wall 17 of the fitting tube portion 12 is inserted into between the covering portion 84 and the facing side wall of the base portion 63 (see FIGS. 1 and 4).

As shown in FIGS. 1 and 11, the restricting portion 83 includes a plurality of ribs 85 coupled to the plate surface of the covering portion 84 while being spaced apart in a length direction of the one side edge of the lid body 79. Each rib 85 is in the form of a plate along the lateral direction and coupled to the plate surface of the covering portion 84 and the outer surface 82A of the lid body 79. Specifically, the respective ribs 85 are arranged on one edge part, the other edge part and an intermediate part between the both edge parts of the covering portion 84. Each rib 85 has a triangular shape (particularly, right triangular shape) and has an inclined edge linearly inclined from a tip part of the covering portion 84 in a projecting direction to the outer surface 82A of the lid body 79.

<Assembly Structure and Assembly Method of Connector>

In assembling, the both arm portions 41 of the lever 40 are inserted into the both space portions 18. In the process of inserting the lever 40, the both arm portions 41 interfere with the support shafts 19 and the outer walls 17 are resiliently deformed outward. After the completion of the insertion, the outer walls 17 resiliently return and the support shafts 19 are fit into the bearing holes 43. In this way, the lever 40 is supported on the housing 10.

Subsequently, the cover 60 is mounted on the housing 10 from behind. In the process of mounting the cover 60, the both first lock receiving portions 68 are inserted inside the lock guide portion 34 and ride on the both first lock portions 33 to be defected and deformed while being guided by the lock guide portion 34. Further, the second lock receiving portion 69 rides on the second lock portion 37 to be deflected and deformed. When the cover 60 is properly mounted on the housing 10, the both first lock receiving portions 68 resiliently return and are locked by the both first lock portions 33 (see FIGS. 1, 3 and 5). Further, the second lock receiving portion 69 resiliently returns and is locked by the second lock portion 37 (see FIG. 6). Further, the interfering portion 38 enters the escaping space 71 to avoid interference with the cover 60. In this way, the cover 60 is held on the housing 10 with detachment restricted. When the cover 60 is properly mounted on the housing 10, the base portion 63 is arranged along the front-rear direction and the vertical direction of the housing 10, and the lateral projecting portion 64 is arranged to project toward the one widthwise side from a lower part of the housing 10 (see FIG. 4). The wires 25 pulled out from the respective seal towers 26 are bent by the back plate portion 65 and the laterally projecting back plate portion 72 and drawn out to outside through an opening on one widthwise side of the lateral projecting portion 64.

On the other hand, if an attempt is made to mount the cover 60 in a posture vertically inverted from a proper posture (hereinafter, referred to as an inverted posture) on the housing 10, the first mount receiving portion 66 is arranged to face the second mounting portion 32 and the second mount receiving portion 67 is arranged to face the first mounting portion 31. Then, one first lock receiving portion 68, out of the both first lock receiving portions 68, interferes with the rear end of the interfering portion 38. In this way, a situation where the cover 60 in the inverted posture is mounted on the housing 10 can be avoided. Even if the one first lock receiving portion 68 rides on the interfering portion 38, this first lock receiving portion 68 is not locked by the interfering portion 38. Further, the second lock receiving portion 69 is not locked by the first lock portion 33 having a different width. Therefore, a situation where the cover 60 in the inverted posture is erroneously mounted on the housing 10 can be reliably avoided.

Thereafter, the corrugated tube 70 is inserted into the lateral projecting portion 64 and the lid cover 62 is rotated from the open state to the closed state with respect to the body cover 61. In the process of rotating the lid cover 62, the plate surface (plate surface on a side not coupled to the respective ribs 85) of the covering portion 84 is displaced along the outer surface 29A of the facing outer wall 17. In this way, a rotating operation of the lid cover 62 is guided.

When the lid cover 62 reaches the closed state, the cover lock portion 81 is inserted inside the bridge portion 77 and locked to the projection 76. In this way, the lid cover 62 is held in the closed state with respect to the body cover 61. The corrugated tube 70 is sandwiched and held between the lid cover 62 and the body cover 61.

Here, the covering portion 84 of the restricting portion 83 is arranged along the vertical direction while the plate surfaces are facing in the front-rear direction. The tip part of the covering portion 84 in the projecting direction is arranged along the vertical direction to cover a lower part of the rear end of the outer surface 29A of the outer wall 17 (see FIG. 1). Thus, the tip part of the covering portion 84 in the projecting direction can cover a clearance between the lateral projecting portion 64 and the outer wall 17 in a side view.

Each rib 85 of the restricting portion 83 is arranged along the lateral direction while the plate surfaces are facing in the vertical direction. The rear end edge of each rib 85 is integrally coupled to the lid body 79 along the lateral direction. The side end edge of each rib 85 is integrally coupled to the covering portion 84 along the front-rear direction and arranged to face the outer surface 82A of the lid body 79 via the covering portion 84. In other words, each rib 85 of the restricting portion 83 is arranged to straddle between the outer surface 29A of the outer wall 17 and the outer surface 82A of the lid body 79.

If an external force is applied to the lid cover 62 to move the lid cover 62 toward the housing 10 away from the body cover 61 (see an arrow Y of FIGS. 1, 3 and 4) such as due to forward swing of the corrugated tube 70 extending outward from the lateral projecting portion 64 or the respective wires 25 drawn out to outside from the corrugated tube 70, there is a concern that the cover lock portion 81 and the cover lock receiving portion 75 are unlocked and the lid cover 62 is accidentally opened. There is also a concern that a locked part of the cover lock portion 81 and the cover lock receiving portion 75 is broken.

However, according to this embodiment, the restricting portion 83 is interposed between the lid body 79 and the outer wall 17 to resist the external force acting in the direction of the arrow Y. Thus, the external force acting in the direction of the arrow Y can be reliably received by the contact of the covering portion 84 of the restricting portion 83 with the outer surface 29A of the outer wall 17. Therefore, it is possible to avoid the application of a large stress to the locked part of the cover lock portion 81 and the cover lock receiving portion 75 and avoid a situation where the locked part is broken. Further, a displacement of the lid body 79 toward the outer wall 17 can be hindered and a situation where the lid cover 62 is accidentally opened can be prevented.

Note that the outer wall 17 tends to be thin by having the space portion 18 inside, and may be defected and deformed when the restricting portion 83 contacts. However, since the arm portion 41 of the lever 40 is arranged in the space portion 18, the outer wall 17 can be prevented from being deflected and deformed by contacting the arm portion 41.

Prior to connector connection, the lever 40 is arranged at the initial position. At the initial position, the lever 40 is arranged to straddle on the base portion 63 from behind.

Subsequently, the receptacle 91 of the mating connector 90 is lightly fit into the fitting space 14 of the housing 10. Then, the both cam followers enter the entrances 45 of the both cam grooves 44. Further, the erroneous assembly preventing protrusion 94 enters the erroneous assembly preventing recess 39. In that state, the coupling portion 42 is gripped and the lever 40 is rotated from the initial position to the connection position. In the rotation process, the both cam followers slide on groove surfaces of the both cam grooves 44, a cam mechanism functions between the lever 40 and the mating connector 90, and the receptacle 91 is deeply fit into the fitting space 14 of the housing 10. When the lever 40 reaches the connection position, the receptacle 91 is fit to a proper depth in the fitting space 14 of the housing 10. In this way, each mating terminal fitting 92 is properly conductively connected to each terminal fitting 23 (see FIG. 5).

On the other hand, if the mating connector 90 is in a connection posture inverted from a proper connection posture with respect to the housing 10, the erroneous assembly preventing protrusion 94 does not reach a position corresponding to the erroneous assembly preventing recess 39 and interferes with the lower end of the fitting tube portion 12. In this way, it is possible to avoid a situation where the receptacle 91 in the inverted connection posture enters the fitting space 14 of the housing 10 and the connector connection erroneously proceeds.

The following can be summarized for this embodiment from the above.

The restricting portion 83 is provided to straddle between the outer surface 29A of the outer wall 17 and the outer surface 82A of the lid body 79. Thus, a stress applied to the cover 60 when the corrugated tube 70 or the like extending outward from the laterally projecting portion 64 is swung in a direction toward the outer surface 29A of the outer wall 17 (see the arrow Y of FIGS. 1, 3 and 4) can be efficiently transmitted to the restricting portion 83. As a result, a state where the cover 60 is held on the housing 10 can be reliably realized.

Particularly, the lid cover 62 can be prevented from being inadvertently opened with respect to the body cove 61. In this case, since the restricting portion 83 is integrally provided to the outer surface 82A of the lid body 79, the lid cover 62 can be opened and closed with the cover 60 mounted on the housing 10.

Further, since the axis of the hinge 78 extends in the direction orthogonal to the outer surface 29A of the outer wall 17 and the covering portion 84 of the restricting portion 83 is arranged along the outer surface 29A of the outer wall 17, even if the lid cover 62 is rotated about the hinge 78, the interference of the lid cover 62 with the outer wall 17 can be avoided. In the process of rotating the lid cover 62, the restricting portion 83 can be displaced along the outer surface 29A of the outer wall 17, wherefore the rotating operation of the lid cover 62 is guided.

Since the restricting portion 83 is provided on the outer surface 82A of the lid body 79, the outer surface 29A of the outer wall 17 can bulge when the arm portion 41 interferes with the cam follower or the like in an assembly process of inserting the arm portions 41 of the lever 40 into the space portions 18 before the cover 60 is held on the housing 10. Therefore, the lever 40 can be assembled without any problem.

Further, since the covering portion 84 of the restricting portion 83 is arranged to cover the clearance between the laterally projecting portion 64 and the outer wall 17 in a side view, the intrusion of water such as high-pressure washing water into the cover 60 or the housing 10 through this clearance can be prevented. Furthermore, since the restricting portion 83 includes the plurality of ribs 85, sufficient durability against external forces can be ensured.

In the case of this embodiment, the first and second mounting portions 31, 32 are not point-symmetric to each other in a back view of the housing 10, and the first and second mount receiving portions 66, 67 are also not point-symmetric to each other in a front view of the cover 60. Thus, unless the first mount receiving portion 66 is mounted in the first mounting portion 31 and the second mount receiving portion 67 is mounted in the second mounting portion 32, the cover 60 is not properly held on the housing 10. Therefore, a situation where the cover 60 in the inverted posture is held on the housing 10 can be avoided.

Particularly, in the case of this embodiment, the cover 60 includes the laterally projecting portion 64 projecting in the direction intersecting a rotating direction (rotating surface) of the lever 60. Thus, if the cover 60 in the inverted posture is held on the housing 10, the lever 40 interferes with the laterally projecting portion 64 in the rotation process and the rotating operation of the lever 40 cannot proceed. In that respect, the connector of this embodiment can avoid the situation where the cover 60 in the inverted posture is held on the housing 10, wherefore usefulness is high for the cover 60 including the laterally projecting portion 64.

The housing 10 includes the pair of first lock portions 33 arranged side by side in a back view in the first mounting portion 31, and one second lock portion 37 in the second mounting portion 32. The cover 60 includes the pair of first lock receiving portions 68 to be fit to the first lock portions 33 in the first mount receiving portion 66. Thus, an operator can know in an early stage whether or not the cover 60 is in a proper mount posture by confirming that the number of the second lock portion 37 is less than that of the first lock portions 33 or confirming that the number of the second lock receiving portion 69 is less than that of the first lock receiving portions 68 in mounting the cover 60. Therefore, a mounting operation of the cover 60 can be quickly started.

Further, the second mounting portion 32 includes the interfering portion 38 at the position side by side with the second lock portion 37 in a back view. The second mount receiving portion 67 includes the escaping space 71 in which the interfering portion 38 is arranged. The interfering portion 38 and the first lock portion 33 are arranged at the positions inverted 180° with the center C1 of the rear surface portion 28 as a center. Thus, if the cover 60 is in the inverted posture, the interfering portion 38 interferes with the first lock receiving portion 68 as a locking partner of the first lock portion 33 and the situation where the cover 60 in the inverted posture is held on the housing 10 can be quickly and reliably avoided.

Furthermore, the interfering portion 38 is internally provided with the erroneous assembly preventing recess 39 extending in the front-rear direction and open in the front end of the fitting tube portion 12. If the mating connector 90 is in the proper connection posture, the erroneous assembly preventing protrusion 94 is arranged inside the erroneous assembly preventing recess 39. On the other hand, if the mating connector 90 is in the connection posture inverted from the proper connection posture, the erroneous assembly preventing protrusion 94 interferes with the opening edge of the fitting tube portion 12 without reaching the position corresponding to the erroneous assembly preventing recess 39. Thus, a situation where the mating connector 90 in the inverted connection posture is erroneously connected can be avoided. Here, since the interfering portion 38 has both a function of preventing erroneous connection of the mating connector 90 and a function of preventing erroneous mounting of the cover 60, the configuration of the housing 10 can be simplified as compared to the case where the both functions are separately provided.

Other Embodiments of Present Disclosure

The embodiment disclosed this time should be considered illustrative in all aspects, rather than restrictive.

Although the restricting portion is integrally provided to the cover in the case of this embodiment, a restricting portion may be integrally provided to a housing as another embodiment.

Although the restricting portion is integrally provided to the cover in the case of this embodiment, restricting portions may be integrally provided to a housing and a cover as another embodiment. Although the cover is composed of the body cover and the lid cover in the case of this embodiment, a cover may be a single tubular body without being distinguished as a body cover and a lid cover as another embodiment.

Although the body cover and the lid cover are coupled via the hinge in the case of this embodiment, a body cover and a lid cover may be separable from each without being coupled via a hinge as another embodiment.

Although the outer surface (housing side surface portion) of the outer wall and the outer surface (cover side surface portion) of the lid body are arranged to be orthogonal to each other in the case of this embodiment, an outer surface (housing side surface portion) of an outer wall and an outer surface (cover side surface portion) of a lid body may be arranged to be inclined at an obtuse or acute angle with respect to the front-rear direction as another embodiment.

Although the first and second mounting portions are arranged at the positions visible in a back view of the housing and the first and second mount receiving portions are arranged at the positions visible in a front view of the cover in the case of this embodiment, first and second mounting portions may be arranged at positions invisible in a back view of a housing and first and second mount receiving portions may be arranged at positions invisible in a front view of a cover as another embodiment.

Although the housing is provided with two first lock portions and one second lock portion and the cover is provided with two first lock receiving portions and one second lock receiving portions in the case of this embodiment, a plurality of second lock portions may be provided as long as the number of the second lock portions is less than that of first lock portions and, similarly, a plurality of second lock receiving portions may be provided as long as the number of the second lock receiving portions is less than that of first lock receiving portions as another embodiment.

Although the first and second mounting portions are arranged on the upper and lower surfaces of the housing and the first and second mount receiving portions are arranged on the upper and lower surfaces of the cover in the case of this embodiment, first and second mounting portions may be arranged at an interval in a circumferential direction on the outer surface of the housing and first and second mount receiving portions may be arranged at an interval in the circumferential direction on the outer surface of the cover as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing including a rear surface portion facing rearward; and a cover for surrounding a wire pulled out from the rear surface portion side, wherein:

the housing includes a first mounting portion and a second mounting portion provided around the rear surface portion, the cover includes a first mount receiving portion and a second mount receiving portion to be respectively mounted to the first and second mounting portions, the first mounting portion includes a first lock portion, the second mounting portion includes a second lock portion and an interfering portion arranged side by side with the second lock portion, the first mount receiving portion includes a first lock receiving portion to be locked by the first lock portion and the second mount receiving portion includes a second lock receiving portion to be locked by the second lock portion and an escaping space, the interfering portion being arranged in the escaping space, and the first lock portion and the interfering portion are arranged at positions inverted 180° with a center of the rear surface portion of the housing as a center in a back view of the housing.

2. The connector according to claim 1, wherein a plurality of the first lock portions are provided side by side in a back view in the first mounting portion, the second lock portion(s) less than the first lock portions is/are provided in the second mounting portion, and one of the plurality of first lock portions is arranged at the position inverted 180° with respect to the interfering portion.

3. The connector according to claim 1, wherein:

the housing includes a fitting tube portion, a mating connector being fit inside the fitting tube portion, and the interfering portion is formed by causing a part of the fitting tube portion to bulge outward and an erroneous assembly preventing protrusion of the mating connector is arranged inside the interfering portion.

4. The connector according to claim 1, comprising a lever rotatably arranged on the housing to proceed with connection to the mating connector, wherein:

the lever is arranged outside the cover, and the cover includes a laterally projecting portion projecting in a direction intersecting a rotating direction of the lever.

5. The connector according to claim 1, wherein the first lock portion and the interfering portion are arranged on a straight line passing through the center of the rear surface portion of the housing.

6. The connector according to claim 1, wherein the housing has a unitary structure.

* * * * *